United States Patent [19]

Fourcaulx et al.

[11] Patent Number: 4,503,303

[45] Date of Patent: Mar. 5, 1985

[54] MINIATURE ELECTRICAL SWITCH

[75] Inventors: Claude Fourcaulx, Chelles; Bernard Fourcaulx, Le Raincy, both of France

[73] Assignee: Atelier de Mecanique de Precision F.M., La Ferriere, France

[21] Appl. No.: 472,033

[22] Filed: Mar. 4, 1983

[30] Foreign Application Priority Data

Jul. 28, 1982 [FR] France ..... 82 13156

[51] Int. Cl.[3] ..... H01H 3/34

[52] U.S. Cl. ..... 200/156; 200/291; 200/11 R; 74/575

[58] Field of Search ..... 200/156, 155 A, 11 R, 200/11 G, 11 TW, 291; 335/140; 74/575, 577 M

[56] References Cited

U.S. PATENT DOCUMENTS

| | | | |
|---|---|---|---|
| 3,196,237 | 7/1965 | Westgate, Jr. | 200/291 X |
| 3,654,413 | 4/1972 | Jordan et al. | 200/156 |
| 3,748,915 | 7/1973 | Winter et al. | 200/156 X |
| 4,112,278 | 9/1978 | Greiner et al. | 200/156 |
| 4,131,771 | 12/1978 | Erickson et al. | 200/291 X |
| 4,257,283 | 3/1981 | Haller et al. | 200/156 X |

FOREIGN PATENT DOCUMENTS

| | | | |
|---|---|---|---|
| 0031038 | 7/1981 | European Pat. Off. . | |
| 2077499 | 12/1981 | United Kingdom | 200/156 |

*Primary Examiner*—Stephen Marcus
*Assistant Examiner*—Ernest G. Cusick
*Attorney, Agent, or Firm*—Parkhurst & Oliff

[57] ABSTRACT

The invention provides an electrical switch having a simplified structure.

In one aspect of the invention, each of the pushers of the mechanism for driving the wheel is brought back to a rest position by the same return means made from a flexible material, this return means having substantially the shape of an X.

The return means is advantageously integrally formed with said two pushers.

9 Claims, 2 Drawing Figures

23b
22b
22a
23a
12
16
20
21b
21a
28
27
34
25
36
35
31
33
30
26
32

MINIATURE ELECTRICAL SWITCH

BACKGROUND OF THE INVENTION

The invention relates to a miniature electrical switch whose design has been studied so as to reduce the number of parts and the assembly time, with a view to lowering its cost price and increasing its reliability.

The miniaturization of electromechanical devices gives rise to considerable problems of reliability and cost price. The fragility of the components, their number, the difficulties of assembly are the principal obstacles which oppose an improvement in the quality/price ratio. Several constructors market at the present time miniaturized electrical switches having typically ten positions, comprising two pushers, respectively for counting up and counting down. Such a type of switch comprises a plastic case which houses the two pushers, as well as a wheel carrying one or more metal brushes in rubbing contact with a printed circuit on which are set the fixed studs of the switch. The printed circuit forms advantageously one of the walls of the case. The wheel bears figures on its cylindrical surface, visible through a window in the case. A drive gear is integral with this wheel and each pusher, movable in translation within the case, carries a tooth capable of engaging with said drive gear so as to cause the wheel to turn in a corresponding direction of rotation. For that, the two pushers are arranged symmetrically on each side of the wheel. A return means is inserted between the end of each pusher and the bottom wall of the case, to urge said pusher away from said gear. The return means is, generally, a small helical spring whose positioning in the case during assembly is a delicate operation. The invention aims more especially at doing away with such helical springs.

SUMMARY OF THE INVENTION

To this end, the invention provides then an electrical switch of the type comprising a case housing a wheel carrying a contact element, said wheel being movable in rotation about a fixed shaft and being provided with one drive gear, at least one pusher movable in translation carrying a tooth capable of engaging with said drive gear and a return means urging said pusher away from said gear, wherein said return means is made from a flexible material and comprises an arm which is resiliently flexible in response to said pusher being pushed in.

In the most frequent case where the switch is equipped with two pushers, respectively for counting up and counting down, arranged in the way indicated above, the return means has advantageously the general shape of an X, two legs of which at least bear on a fixed part of the case, for example the lateral bottom wall of said case, whereas the other two legs join up respectively with the two ends of said pushers. Thus, the return means is common to the two pushers and it may advantageously be integrally formed therewith. In this latter case, a single part is thus obtained where previously known mechanisms had four.

BRIEF DESCRIPTION OF THE DRAWINGS

The invention will be better understood and other advantages will become clearer from the following description of a presently preferred embodiment of an electrical switch in accordance with its principle, given solely by way of example and made with reference to the accompanying non limiting drawings in which.

DESCRIPTION OF THE PREFERRED EMBODIMENT

Figure 1:
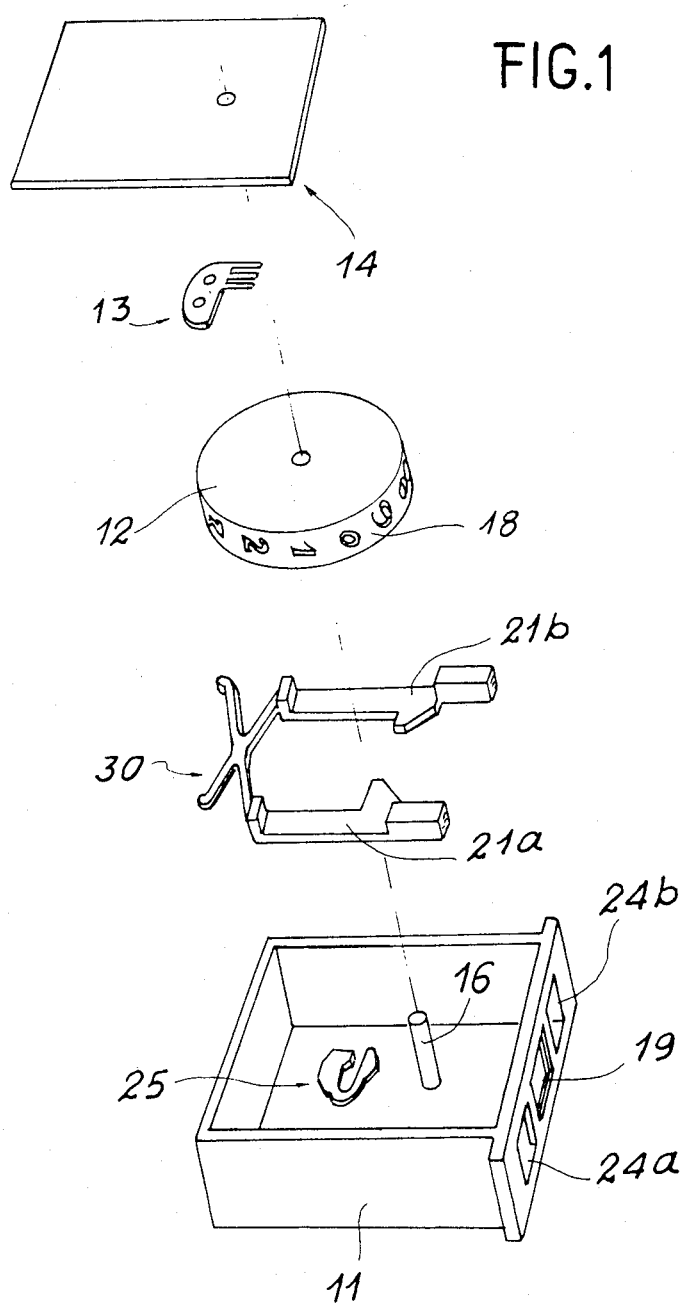
FIG. 1 is an exploded perspective view of a switch in accordance with the invention.

The electrical switch shown comprises a hollow case 11 in the form of a rectangular parallelepiped, a wheel 12 carrying a contact element 13 (metal brush) on one of its flat faces and a printed circuit 14 forming advantageously the lid of the hollow case. Conventionally, this latter carries the fixed contact studs (not shown) of the switch, the contact element 13 coming selectively into engagement with the studs. The cylindrical face 18 of the wheel 12 carries figures visible through window 19 in case 11. As is shown more particularly in FIG. 2, a drive gear 20 is integral with wheel 12 and arranged coaxially therewith. Gear 20 comprises as many teeth as the switch comprises different positions. Two pushers 21*a* and 21*b* are mounted movable in translation within case 11 and on each side of gear 20. Each one comprises a tooth 22*a*, 22*b* capable of engaging with the drive gear 20. Each pusher has one end 23*a*, 23*b* which projects from case 11 on each side of wheel 19, through corresponding openings 24*a*, 24*b*. A pawl 25 for positioning wheel 12 is integral with the wall of case 11 opposite the printed circuit 14. It is formed of a base 26 and a flexible part 27 in engagement with gear 20. This flexible part is mounted with respect to gear 20 so as to be constantly urged resiliently theretowards. Its edge 28 has a ramp profile designed so that two adjacent teeth of gear 20 are always positioned in the same way with respect thereto, when said gear has been rotated through a certain angle by one or other of the pushers 21*a* or 21*b*. Each pusher drives the wheel in one of the possible directions of rotation, pusher 21*a* is then for example called count up pusher, whereas pusher 21*b* is called count down pusher.

Figure 2:
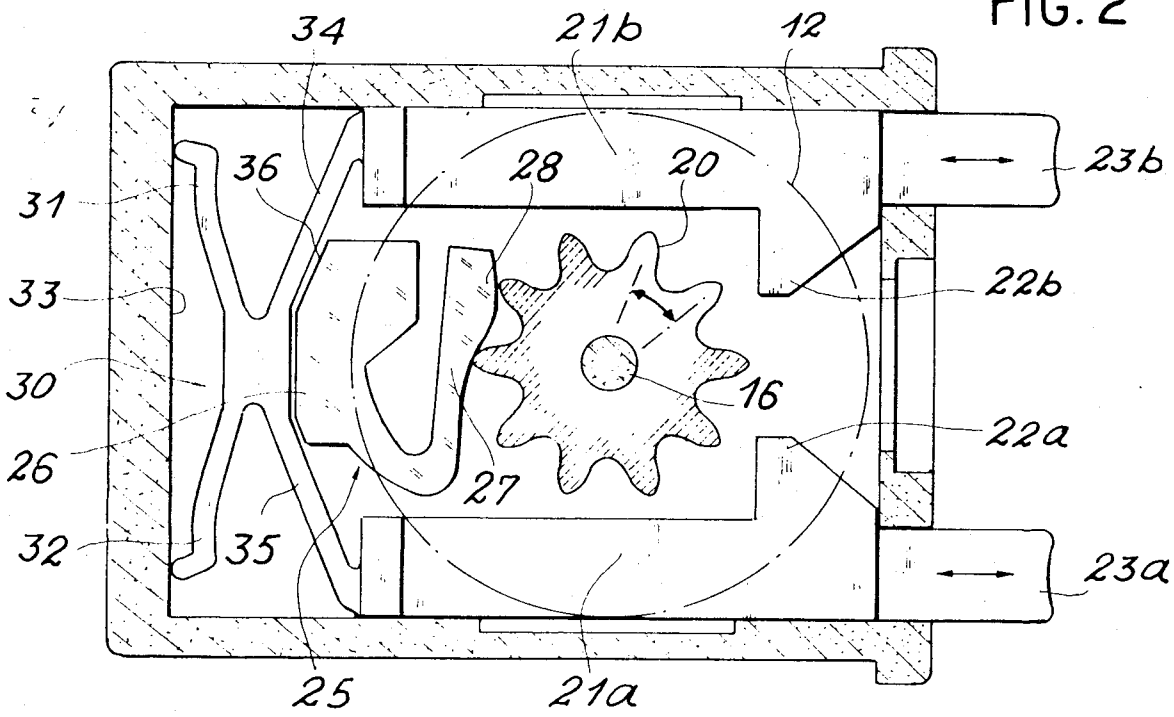
FIG. 2 is an enlarged view of the same switch, through a section passing through the drive gear.

In accordance with the invention, each pusher is urged away from gear 20 by a return means made from a flexible material comprising at least one resiliently flexible arm. In the example shown, this return means 30 is common to the two pushers 21*a* and 21*b* and it has substantially the general shape of an X whose legs 31, 32 bear against the lateral bottom wall 33 of the case, whereas ends of the other two legs 34, 35 join up respectively with the two internal ends of pushers 21*a* and 21*b* by engagement with the ends at a position physically located between the end of the associated pusher and the wall 33 as shown in FIG. 2.

According to a further advantageous feature of the invention, the X shaped return means 30 is integrally formed with the two pushers 21*a* and 21*b*, as is clearly shown in FIG. 1.

Thus, the assembly of the unit formed by the two pushers and the return means 30 inside case 11 presents no difficulty and may be carried out extremely rapidly, even automatically. The correct positioning of this unit is further facilitated by the fact that the base 26 of pawl 25 has a lateral wall 36 which reproduces substantially a part of the shape of the return means 30 so that a housing 37, specifically adapted to the shape and dimensions of the return means 30, is provided in the case, which facilitates the positioning and the maintenance in position of the assembly formed by this return means and the pushers.

The operation of such a switch clearly follows from the preceding description. The fact of pressing in one or other of the pushers causes wheel 12 to rotate in one or other direction through an angle sufficent to disengage one of the two teeth of gear 20 which were previously in contact with the flexible part 27 of the positioning pawl 25. A new stable position between the pawl and the gear is then reached through the action of ramp 28. The manual pressure exerted on one or other of the pushers takes place against a light resilient force produced by return means 30 and, more particularly the flexible legs thereof.

Of course, the invention is not limited to the embodiment which has just been described, but comprises all the technical equivalents of the means used if these are within the scope of the following claims.

What is claimed is:

1. In an electrical switch of the type comprising a case, a wheel disposed within said case and rotatably movable about an axis, a drive gear coupled to said wheel for rotating said wheel, a contact element connected to said wheel, at least one pusher coupled for movement within said case and including an end and a tooth for engaging said drive gear, and a return means for engaging said end and urging said pusher away from said drive gear, the improvement in said return means comprising:

a flexible material constructed to have substantially the configuration of an X to form four legs, two adjacent legs having ends constructed and arranged to engage a fixed part of said case and at least one of the other of said four legs having an end physically located between the end of said at least one pusher and said fixed part of said case.

2. The switch of claim 1 wherein said return means and said pusher are integrally formed.

3. The switch of claim 1 wherein said at least one pusher comprises two pushers disposed in said case parallel to one another on opposite sides of said drive gear, said return means being constructed and arranged to commonly push the tooth of each pusher away from said gear.

4. The switch of claim 3 wherein the two legs of said return means which do not engage the fixed part of said case are each coupled to an end of a different one of said two pushers.

5. The switch of claim 4 wherein said return means and said two pushers are integrally formed.

6. The switch of claim 1 further comprising a pawl integral with a wall of said case and including a flexible part coupled to engage a portion of said gear to position said wheel and a base having a lateral wall constructed and arranged inside of said case to form a housing configuration cooperating to position and maintain the position of said return means within said case.

7. In a rotating mechanism of the type including a housing, a wheel disposed within said housing for rotation about an axis, a drive gear coupled to rotate said wheel, at least one pusher element disposed for slidable movement within said housing and including an end and a tooth engageable with said drive gear during said sliding movement for rotating said wheel, and means engaging said end for resiliently urging said tooth out of engagement with said drive gear, the improvement in said means for urging comprising:

a flexible element constructed and arranged to have an X-shaped configuration defining four legs and disposed within said housing to urge the tooth of said at least one pusher element out of engagement with said gear, two adjacent ones of said legs having ends constructed and arranged to engage a fixed part of said housing and at least one of the other of said four legs having an end physically located between the end of said at least one pusher element and said fixed part of said housing, said at least one pusher element end being integrally coupled to the end of said at least one of the other of said four legs of said flexible element; and a pawl coupled within said housing and having a flexible portion constructed and arranged to engage said gear to position said wheel and a base portion constructed and arranged to form a configuration which facilitates the positioning and maintenance of the position of the flexible element and its integral pusher element within said housing.

8. The mechanism of claim 7, wherein said at least one pusher element comprises two pusher elements, said X-shaped configuration forming four legs in adjacent pairs, two of said legs in one pair being coupled to engage said housing and each of the legs in the other of said pairs integrally coupled to a different one of said pusher elements.

9. In a rotating mechanism of the type including a housing, a wheel disposed within said housing for rotation about an axis, a drive gear coupled to rotate said wheel, at least one pusher element disposed for slidable movement within said housing and including an end and a tooth engageable with said drive gear during said sliding movement for rotating said wheel, and means for engaging said end and resiliently urging said tooth out of engagement with said drive gear, the improvement in said means for urging comprising:

a flexible element constructed and arranged to have an X-shaped configuration defining four legs an disposed within said housing to urge the tooth of said at least one pusher element out of engagement with said gear, two adjacent ones of said legs having ends constructed and arranged to engage a fixed part of said housing and at least one of the other of said four legs having an end physically located between the end of said at least one pusher element and said fixed part of said housing.

* * * * *